US007363860B2

(12) United States Patent
Wilson et al.

(10) Patent No.: US 7,363,860 B2
(45) Date of Patent: Apr. 29, 2008

(54) NON-EXPLOSIVE TWO COMPONENT INITIATOR

(75) Inventors: Paul Wilson, Houston, TX (US); Kevin L. Gray, Friendswood, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 125 days.

(21) Appl. No.: 11/290,180

(22) Filed: Nov. 30, 2005

(65) Prior Publication Data

US 2008/0047449 A1 Feb. 28, 2008

Related U.S. Application Data

(60) Provisional application No. 60/631,686, filed on Nov. 30, 2004.

(51) Int. Cl.
*F42B 3/18* (2006.01)
*F42D 3/04* (2006.01)

(52) U.S. Cl. ..... 102/205; 102/304; 102/315; 102/275.11

(58) Field of Classification Search ..... 102/202.5, 102/202.7, 205, 275.11, 304, 315
See application file for complete search history.

(56) References Cited

U.S. PATENT DOCUMENTS 3,181,463 A * 5/1965 Morgan et al. ..... 102/202.7
3,952,656 A * 4/1976 Fox et al. ..... 102/304
3,955,505 A 5/1976 Johnston
4,869,170 A * 9/1989 Dahmberg et al. ..... 102/202.5
4,938,137 A * 7/1990 Guay ..... 102/202.7
5,005,641 A 4/1991 Mohaupt
5,052,301 A * 10/1991 Walker ..... 102/202.7
5,347,929 A 9/1994 Lerche et al.
5,789,697 A 8/1998 Engelke et al.
6,386,108 B1 * 5/2002 Brooks et al. ..... 102/217
6,752,083 B1 * 6/2004 Lerche et al. ..... 102/202.7

(Continued)

FOREIGN PATENT DOCUMENTS

EP 0 279 796 2/1988

(Continued)

OTHER PUBLICATIONS

SQ-80 EBW Ignitor, P/N 188-7382, www.risi-usa.com, May 20, 2004.

(Continued)

*Primary Examiner*—Bret Hayes
(74) *Attorney, Agent, or Firm*—Patterson & Sheridan, L.L.P.

(57) ABSTRACT

Methods and apparatus for detonating explosives or igniting flammables are disclosed. According to some embodiments of the invention, initiators include an initiating component holding an exploding bridgewire (EBW) or an exploding foil initiator (EFI) and a flammable component housing thermite. An end of the flammable component mates with a corresponding end of the initiating component. A method of initiating the explosives or flammables includes connecting the two components to assemble the initiator, disposing the initiator proximate the explosives or flammables, and activating the initiator to cause ignition of the thermite that then initiates the explosives or flammables. Additionally, a non-explosive kit for the initiator includes the two components with the EBW or EFI initially spaced from the thermite within the flammable component to make the initiator disarmed until final assembly thereof. Cutting torches and perforating guns provide examples of downhole tools that benefit from aspects of the invention.

28 Claims, 3 Drawing Sheets

U.S. PATENT DOCUMENTS

| | | | |
|---|---|---|---|
| 2002/0152913 | A1 | 10/2002 | Bernard et al. |
| 2003/0116052 | A1 | 6/2003 | Fogle, Jr. |
| 2004/0089450 | A1 | 5/2004 | Slade et al. |

FOREIGN PATENT DOCUMENTS

| | | |
|---|---|---|
| EP | 1 209 436 | 5/2002 |

OTHER PUBLICATIONS

JRC—Jet Research Center, "Red Detonator", The Industry Leader in Perforating Safety, Nov. 2002.

Radial Cutting Torch, Operating Manual, MCR Oil Tools, Aug. 2002.

EP Search Report, Application No. 05111338.9, dated Apr. 5, 2006.

* cited by examiner

NON-EXPLOSIVE TWO COMPONENT INITIATOR

CROSS-REFERENCE TO RELATED APPLICATIONS

This application claims benefit of U.S. provisional patent application Ser. No. 60/631,686, filed Nov. 30, 2004, which is herein incorporated by reference.

BACKGROUND OF THE INVENTION

1. Field of the Invention

Embodiments of the invention generally relate to initiators for detonating explosives or igniting flammable solids. More particularly, embodiments of the invention relate to non-explosive initiators for use with downhole tools requiring initiation to detonate explosives or ignite flammable solids therein.

2. Description of the Related Art

Forming a hydrocarbon well typically begins by drilling a borehole from the earth's surface to a selected depth in order to intersect a hydrocarbon bearing formation. Steel casing typically lines the borehole formed in the earth. This creates an annular area between the casing and the borehole that is filled with cement to further support and form the wellbore.

Various drilling and completion operations utilize tools having explosives or flammable solids therein that must be either detonated or ignited at a desired time and location in the wellbore. For example, one type of radial cutting torch uses a flammable solid to produce a high velocity jet that pyrotechnically cuts tubing located in the wellbore. This ability to cut tubing downhole becomes necessary when a tubular string becomes stuck in the wellbore and requires removal in order to continue operations. In another example, perforating guns typically use radially oriented shaped charges that are connected by a detonating cord and detonated at a predetermined depth in the wellbore to form perforations in the casing, the cement and/or the formation. The perforations caused by the firing of the shaped charges enable and/or enhance production at that location in the wellbore.

Initiators detonate or ignite the explosives or flammable solids, which are known as secondary loads, disposed in the tools by first initiating a primary load within the initiator that then initiates the secondary load. Past initiators include a low energy initiator that utilizes an electronic controller with lead wires connected to a bridgewire that only needs to be heated to the ignition temperature of the primary load of a primary explosive such as lead azide next to the bridgewire. Radio frequency (RF) sources and stray voltages found on well sites and offshore platforms from devices such as radio transmitters, electric welders, and cathodic protection equipment must be turned off in order to prevent the lead wires from acting as an antennae and supplying a current which could cause premature and potentially catastrophic initiation of the tool. Thus, going "radio silent" when non-radio-safe initiators are used interrupts valuable work time at the rig and effects incoming helicopter flights trying to locate the rig and data communication systems between the rig and shore that monitor and control various rig systems remotely.

More recently, the tools requiring initiation employ radio safe initiators using an exploding bridgewire (EBW) or an exploding foil initiator (EFI) to initiate a material, such as a secondary explosive, that is less thermally sensitive than a primary explosive used in past initiators. With the EBW, a large amount of energy is applied very rapidly into a thin bridgewire such that the current heats the wire through the melting, boiling and vaporization phases to provide an explosion that gives off thermal energy and a shock wave used to initiate the primary load of the initiator. Regarding the EFI, a large amount of energy is applied very rapidly into a thin metal foil which vaporizes to cause a flyer material to accelerate toward and impact the primary load of the initiator such that the primary load is initiated. In contrast to the low energy initiators of the past, the initiators with the EBW and the EFI require additional electronic circuitry such as capacitors to reach a high energy threshold required for functioning. The threshold can be approximately 200 kilowatts and 200 amperes. Thus, these high thresholds make the initiators with the EBW and the EFI immune from stray voltages and less susceptible to accidental initiation.

While current initiators are safer, they are still classified as explosives, which require special shipping, storage and handling. One type of initiator device utilizes an EBW in combination with a flammable solid that includes a mixture of ferrous oxide and aluminum, known as thermite. This combination requires that the initiator device be classified and regulated as an explosive device.

Furthermore, obtaining explosive licenses in international locations requires increasingly more lead time and is becoming more complex. Thus, the initiator must be shipped on more costly non-passenger flights and meet other handling requirements even though some of the tools that the initiator is being used with are not classified as explosives. Accordingly, the classification of the initiator as an explosive increases costs and time required to get the initiators to the site of the rig.

Thus, there exists a need for initiators that are radio safe, shippable by standard air freight, otherwise safe to handle and ship and do not require explosive permits and licenses. A further need exists for initiators for use with downhole tools, particularly those tools that utilize flammable solids.

SUMMARY OF THE INVENTION

Embodiments of the invention generally relate to methods and apparatus for detonating explosives or igniting flammables. According to some embodiments of the invention, initiators include an initiating component holding an exploding bridgewire (EBW) or an exploding foil initiator (EFI) and a flammable component housing thermite. An end of the flammable component mates with a corresponding end of the initiating component. A method of initiating the explosives or flammables includes connecting the two components to assemble the initiator, disposing the initiator proximate the explosives or flammables, and activating the initiator to cause ignition of the thermite that then initiates the explosives or flammables. Additionally, a non-explosive kit for the initiator includes the two components with the EBW or EFI initially spaced from the thermite within the flammable component to make the initiator disarmed until final assembly thereof. Cutting torches and perforating guns provide examples of downhole tools that benefit from aspects of the invention.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the invention generally relate to initiators that have a two component design and utilize a flammable solid and an exploding bridge wire (EBW), an exploding foil initiator (EFI) or any other suitable bridge wire mechanism. While applications are illustrated for use in downhole tools, the initiators disclosed herein enable detonation of various explosives or ignition of different flammable materials in any other application requiring such initiation. Since the two components of the initiator are individually non-explosive, the initiators described below can be shipped, handled and stored as a non-explosive kit prior to final assembly of the two components without special requirements associated with explosives. For some embodiments, the components of the initiators may be shipped in separate containers to a location where they are finally assembled for use. Furthermore, the initiators once finally assembled continue to provide safety benefits associated with initiators utilizing the EBW and the EFI, such as being radio safe, and can be disassembled if necessary.

Figure 1:
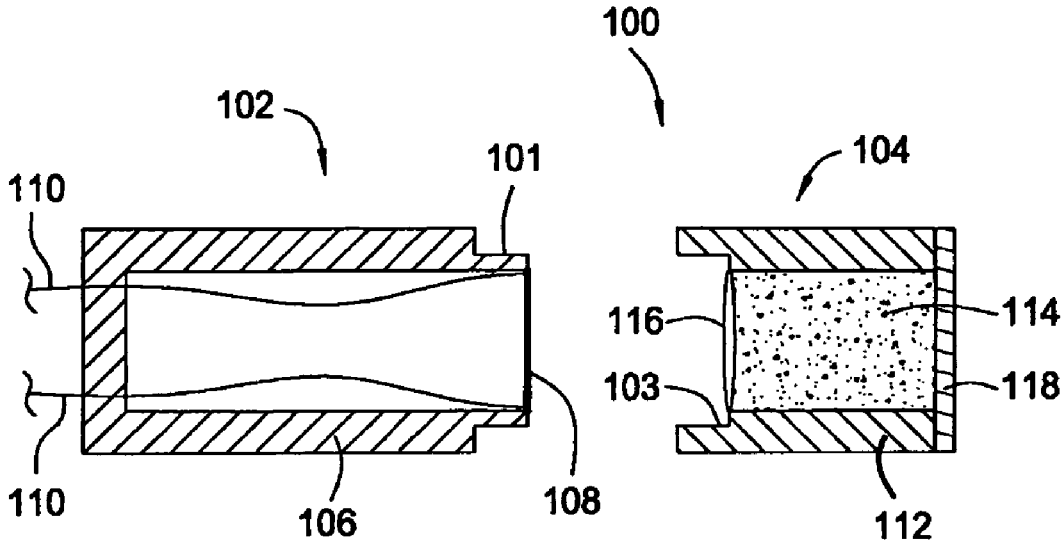
FIG. 1 is a section view of an initiator that includes an initiating component having an end configured to mate with a corresponding end of a flammable component.

FIG. 1 shows an initiator 100 that includes an initiating component 102 having an end 101 configured to mate with a corresponding end 103 of a flammable component 104. The initiating component 102 includes a housing 106 that supports an initiating device 108 proximate the end 101 of the initiating component 102. Preferably, an EBW forms the initiating device 108. For other embodiments, an EFI forms the initiating device 108.

The flammable component 104 includes a sleeve 112 for holding a flammable substance 114. Preferably, the flammable substance 114 includes a flammable or detonating material such as thermite, lead azide, pentaerythritol tetranitrate (PETN), cyclotrimethylene trinitramine (cyclonite or RDX) or any other suitable energetic material. A barrier 116 such as a piece of paper or MYLAR® and an end cap portion 118 of the sleeve 112 may further contain the flammable substance within the sleeve 112.

Lead wires 110 connect to the initiating device 108 and exit the housing 106 for connection to appropriate electrical circuitry used to set off the initiating device 108 and hence activate the initiator 100. Accordingly, the lead wires 110 can exit the housing 106 as individual wires or as a coaxial for hookup or as a multi-pin assembly into which a cable mates for connection to the electrical circuitry. Commercially available electrical circuitry exists for selection depending on the type of the initiating device 108 and the specific application of the initiator 100. Only one of the lead wires 110 may be required for some embodiments such as when the initiator 100 is grounded.

Final assembly of the components 102, 104 of the initiator 100 does not occur until on location and at a desired time prior to when the initiator 100 is needed. The ends 101, 103 of the components 102, 104 facilitate coupling of the components 102, 104 to one another during final assembly of the initiator 100. Specifically, the ends 101, 103 define any type of mechanical interrelatedness used to form a connection, such as a threaded connection. Once finally assembled, the initiating device 108 aligns in close proximity to the flammable substance 114 such that the initiating device 108 can be caused to ignite the flammable substance 114 upon activating the initiator 100.

Figure 2:
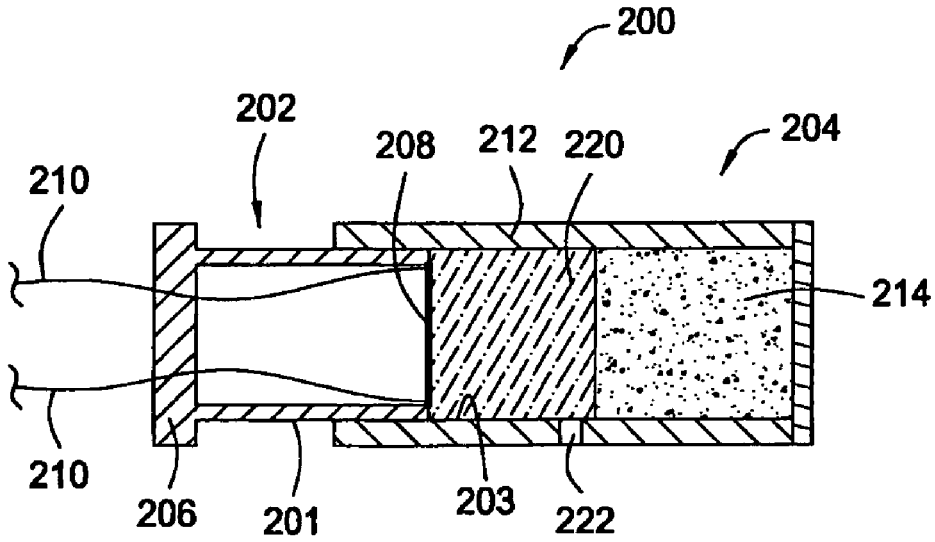
FIG. 2 is a section view of an initiator according to an alternative embodiment that includes an initiating component having an end movably coupled to a mating end of a flammable component.

FIG. 2 illustrates an initiator 200 according to an alternative embodiment that includes an initiating component 202 having an end 201 movably coupled to a mating end 203 of a flammable component 204. Similar to the initiator 100 shown in FIG. 1, the initiator 200 includes a flammable substance 214 disposed in a sleeve 212 of the flammable component 204 and lead wires 210 connected to an initiating device 208 held within a housing 206 of the initiating component 202. The initiating component 202 is initially held in a disarmed position with the initiating device 208 spaced away from the flammable substance 214 such that the flammable substance 214 does not ignite to activate the initiator 200 even if the initiating device 208 is set off. Additionally, an optional filler material 220, such as a silicone oil or petroleum jelly, disposed within the sleeve 212 between the initiating device 208 and the flammable substance 214 further blocks the initiating device 208 from the flammable substance 214 while in the disarmed position.

Final assembly of the components 202, 204 places the initiator 200 in a ready position (see FIG. 4) only when on location and at a desired time prior to when the initiator 200 is needed. The final assembly involves sliding the components 202, 204 relative to one another to place the initiator 200 in the ready position such that the initiating device 208 can be caused to ignite the flammable substance 214 upon activating the initiator 200. The smaller outer diameter of the end 201 of the initiating component 202 enables relative sliding movement of the initiating component 202 within the larger inner diameter of the sleeve 212. A port 222 within the sleeve 212 permits ejection of the filler material 220 from within the sleeve 212 when the initiating component 202 moves from the disarmed position to the ready position. Any type of mechanical interrelatedness between the components 202, 204 can selectively retain the components in either the disarmed position prior to final assembly or the ready position after sliding the components 202, 204 to align and place the initiating device 208 in close proximity with the flammable substance 214. This sliding movement of the initiating component 202 relative to the flammable component 204 can occur at the surface by an operator or once the tool is downhole by an actuation mechanism.

Figure 3:
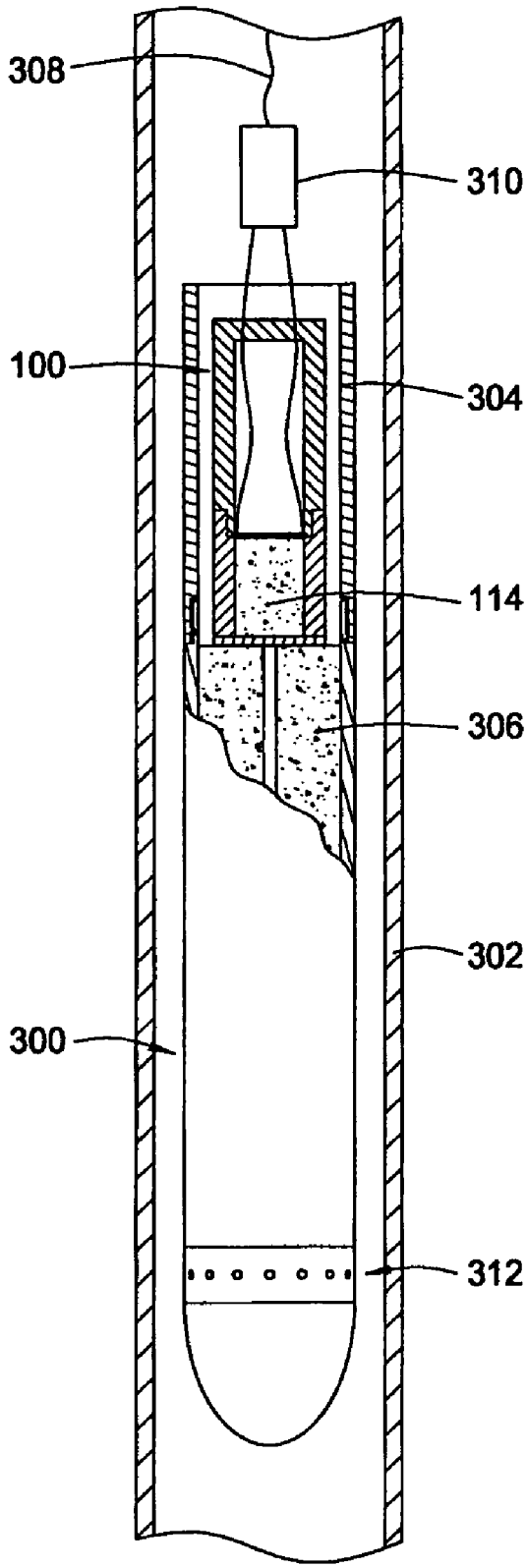
FIG. 3 is a partial section view of an initiator according to aspects of the invention assembled within a radial cutting torch that is disposed in a tubular to be cut.

FIG. 3 shows the initiator 100 after final assembly thereof and coupling with a radial cutting torch 300 disposed in a tubular 302 to be cut. An initiator sub 304 coupled to the radial cutting torch 300 houses the initiator 100 in close proximity with wafers of thermite 306 disposed in the radial cutting torch 300. The initiator 100 electrically connects to an electronics module 310 designed to activate the initiator 100 upon receipt of a signal through the wire line 308, which can also be used to lower the entire assembly into the wellbore. In operation, the flammable substance 114, such as thermite, in the initiator 100 ignites upon activating the initiator 100. Since the initiator 100 is capable of igniting the thermite 306 in the radial cutting torch 300 at distances in excess of five inches away, ignition of the flammable substance 114 in the initiator 100 then ignites the thermite 306 in the radial cutting torch 300. The ignited thermite 306 flows out a nozzle 312 of the radial cutting torch 300 to produce a high-velocity jet of molten metal and gas that cuts the tubular 302.

Figure 4:
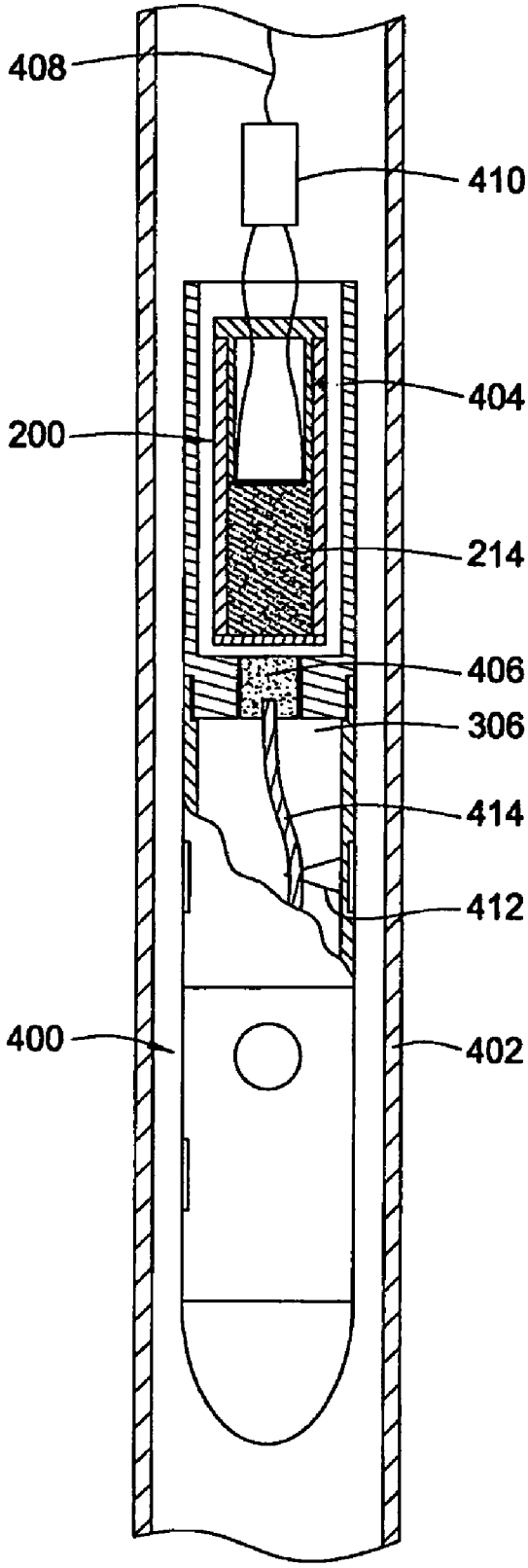
FIG. 4 is a partial section view of an initiator according to aspects of the invention assembled within a perforating gun that is disposed in a casing to be perforated.

FIG. 4 shows the initiator 200 after final assembly thereof and coupling with a perforating gun 400 lowered by a wireline 408 to a desired location in a casing 402 to be perforated. An initiator sub 404 coupled to the perforating gun 400 houses the initiator 200 in close proximity with a detonating cord 414 that is optionally disposed within a booster 406. Generally, the booster 406 includes an aluminum shell filled with explosives and crimped to the detonating cord 414. However, any commercially available booster such as used between tool joints can provide additional thermal and shock sensitivity necessary to ensure that detonation of the detonating cord 414 occurs and goes to a high order explosive. The detonating cord 414 clamps to a back end of shaped charges 412 arranged throughout the perforating gun 400. In operation, an electronics module 410 supplies the required voltage and current to activate the initiator 200 at the desired time. Once ignited, the flammable substance 214, such as thermite, within the initiator 200 detonates the booster 406 and detonating cord 414. The detonation propagates along the detonating cord 414 to set off the shaped charges 412 that penetrate the casing 402.

While the foregoing is directed to embodiments of the present invention, other and further embodiments of the invention may be devised without departing from the basic scope thereof, and the scope thereof is determined by the claims that follow.

The invention claimed is:

1. A method of initiating a reactive material, comprising:

providing an initiator having an initiating component substantially devoid of stored chemical energy and a flammable component substantially devoid of an initiation mechanism for initiating a flammable substance within the flammable component;

connecting mating ends of the components to assemble the initiator, wherein the connecting the mating ends occurs at a rig site;

disposing the initiator proximate the reactive material; and activating the initiator to cause ignition of the flammable substance within the flammable component and thereby initiate the reactive material.

2. The method of claim 1, wherein the connecting the mating ends occurs on location proximate to where the reactive material is to be initiated.

3. The method of claim 1, further comprising transporting and storing the initiator with the components separated from one another.

4. The method of claim 1, wherein the connecting the mating ends comprises sliding the components relative to one another to bring an initiating device of the initiating component into proximity with the flammable substance in the flammable component.

5. The method of claim 4, wherein sliding the components occurs downhole.

6. The method of claim 1, wherein activating the initiator functions an exploding bridgewire (EBW) of the initiating component.

7. The method of claim 1, wherein activating the initiator functions an exploding foil initiator (EFI) of the initiating component.

8. The method of claim 1, wherein the flammable substance comprises thermite.

9. The method of claim 1, wherein the reactive material comprises thermite.

10. The method of claim 1, wherein the reactive material comprises a detonating material.

11. A method of initiating a reactive material, comprising:

providing an initiator having an initiating component substantially devoid of stored chemical energy and a flammable component substantially devoid of an initiation mechanism for initiating a flammable substance within the flammable component;

connecting mating ends of the components to assemble the initiator;

disposing the initiator proximate the reactive material; and activating the initiator to cause ignition of the flammable substance within the flammable component and thereby initiate the reactive material, wherein initiating the reactive material functions a perforating gun.

12. A method of initiating a reactive material, comprising:

providing an initiator having an initiating component substantially devoid of stored chemical energy and a flammable component substantially devoid of an initiation mechanism for initiating a flammable substance within the flammable component;

connecting mating ends of the components to assemble the initiator;

disposing the initiator proximate the reactive material; and activating the initiator to cause ignition of the flammable substance within the flammable component and thereby initiate the reactive material, wherein initiating the reactive material functions a cutting torch.

13. A kit for an initiator used to initiate a thermally sensitive material, comprising:

an initiating component devoid of stored chemical energy and having an initiating device; and a flammable component devoid of an initiation mechanism and for housing a flammable substance such that the initiating device can only be caused to initiate the flammable substance by proximity once assembled, wherein an end of the flammable component is adapted to mate with a corresponding end of the initiating component, and wherein the initiating device is initially separated from the flammable substance to make the initiator disarmed until final assembly thereof.

14. The kit of claim 13, wherein the components are physically separated from one another.

15. The kit of claim 13, wherein the ends of the components enable sliding movement of the components relative to one another in order to selectively position the initiating device proximate the flammable substance.

16. The kit of claim 13, wherein the initiating component includes none of the flammable substance.

17. The kit of claim 13, wherein a filler material is initially disposed between the initiating device and the flammable substance.

18. The kit of claim 13, wherein the initiating device comprises an exploding bridgewire (EBW).

19. The kit of claim 13, wherein the initiating device comprises an exploding foil initiator (EFI).

20. The kit of claim 13, wherein the flammable substance comprises thermite.

21. A kit for an initiator used to initiate a thermally sensitive material, comprising:

a cutting torch;

an initiating component having an initiating device; and a flammable component for housing a flammable substance, wherein an end of the flammable component is adapted to mate with a corresponding end of the initiating component, and wherein the initiating device is initially separated from the flammable substance to make the initiator disarmed until final assembly thereof.

22. A method of initiating a chemically energetic material, comprising:

providing an initiator having an initiating component and a separate reactive chemical component;

connecting mating ends of the components to assemble the initiator;

disposing the initiator within a tool body proximate the chemically energetic material disposed therein;

lowering the tool body into a wellbore; and activating the initiator to cause initiation of the reactive chemical component that then initiates the chemically energetic material.

23. A method of transporting and handling a chemically energetic material initiator, comprising:

providing a first initiator component, the first initiator component being devoid of stored chemical energy and capable of providing an output signal in response to an input signal from an energy source;

providing a second initiator component, the second initiator component including a reactive substance and being devoid of an initiation mechanism for initiating the reactive substance, wherein the reactive substance can be caused to initiate by the output signal being in proximity to the reactive substance once the components are assembled together;

arranging the first and second initiator components such that the second initiator component cannot receive the output signal from the first initiator component; and transporting the first and second initiator components in such arrangement.

24. The method of claim 23, wherein the arranging includes physically isolating.

25. The method of claim 24, wherein physically isolating includes using separate packages for each of the first and second initiator components.

26. The method of claim 23, wherein the arranged initiator components can be shipped in accordance with a hazard classification corresponding to articles no more hazardous than flammable solids.

27. The method of claim 23, wherein the first initiator component includes a first connection member and the second initiator component includes a second connection member and the first and second connection members are inter-engageable.

28. The method of claim 27, further comprising receiving the arranged initiator components at a destination location, following transporting, and inter-engaging the connection members.

* * * * *